United States Patent [19]

Hürlemann et al.

[11] 4,135,434

[45] Jan. 23, 1979

[54] BREECHBLOCK FOR AN AUTOMATIC FIRING WEAPON

[75] Inventors: Ernst Hürlemann; Werner Bosshard, both of Zürich, Switzerland

[73] Assignee: Werkzeugmaschinenfabrik Oerlikon-Bührle AG, Zürich, Switzerland

[21] Appl. No.: 846,913

[22] Filed: Oct. 31, 1977

[30] Foreign Application Priority Data

Nov. 12, 1976 [CH] Switzerland ..... 14250/76
May 26, 1977 [CH] Switzerland ..... 6488/77

[51] Int. Cl.[2] ..... F41D 11/06
[52] U.S. Cl. ..... 89/181; 89/190
[58] Field of Search ..... 89/164, 176, 181, 190

[56] References Cited

U.S. PATENT DOCUMENTS 2,213,953 9/1940 Conlon ..... 89/164

*Primary Examiner*—Stephen C. Bentley

*Attorney, Agent, or Firm*—Werner W. Kleeman

[57] ABSTRACT

A breechblock for an automatic firing weapon comprising a breechblock housing containing a breechblock head displaceable in the breechblock housing. There is also provided at least one movable blocking body by means of which the breechblock head can be locked in a firing position with the breechblock housing. A spring-loaded control element is arranged to be displaceable in the breechblock housing, this control element containing a control surface by means of which there can be positionally adjusted the blocking or locking body. In the breechblock head there is arranged a locking bolt which can be shifted into a recess of the control element. By means of the locking bolt the breechblock head, which is unlocked from the breechblock housing, can be coupled with the control element, and play is present between the control surface and the blocking body and by means of which, prior to reaching the firing position of the breechblock head, there is uncoupled the control element.

9 Claims, 16 Drawing Figures

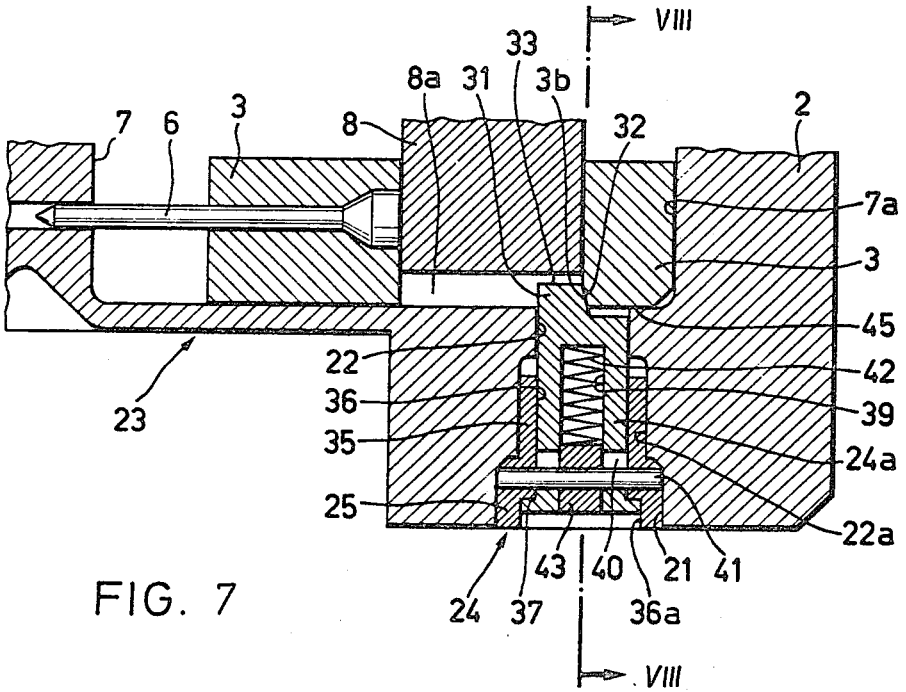
FIG. 7
FIG. 8
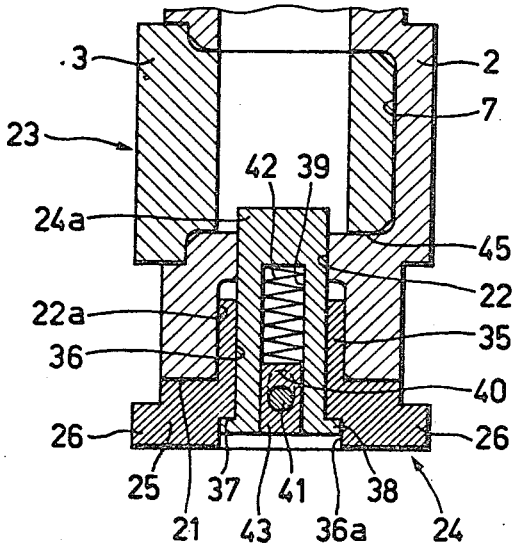

FIG. 15
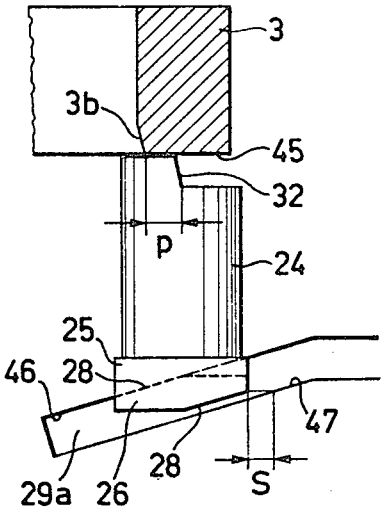
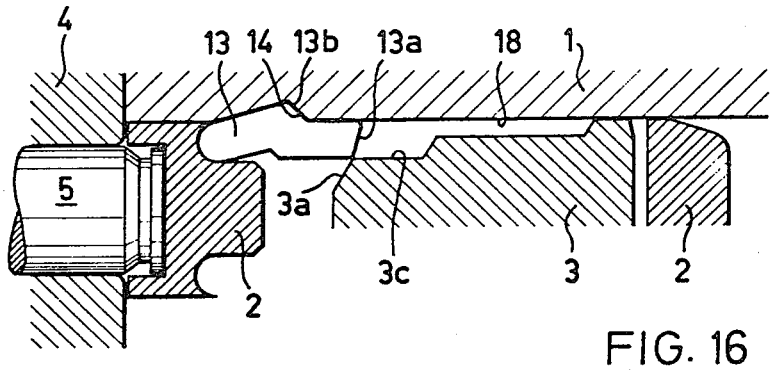
FIG. 16

BREECHBLOCK FOR AN AUTOMATIC FIRING WEAPON

BACKGROUND OF THE INVENTION

The present invention relates to a new and improved breechblock for an automatic firing weapon, comprising a breechblock housing, a breechblock head displaceable in the breechblock housing, at least one movable blocking or locking body by means of which the breechblock head can be locked in a firing position with the breechblock housing, there further being provided a spring-loaded control element which is displaceable in the breechblock housing and possesses a control surface by means of which there can be adjusted the blocking or locking body.

With a state-of-the-art breechblock of this general type the blocking or locking bodies are constructed as locking elements pivotably arranged at the breechblock head. In the firing position the control element, by means of its control surfaces, pivots the locking elements outwardly into a blocking position where they bear against catch or locking surfaces of the breechblock housing. After firing a shot the control element is moved rearwards, and the locking elements are rocked into a release position where they bear upon the control surfaces of the control element. This bearing or support action take place during the entire movement of the breechblock body composed of the breechblock head and the control element, until the locking elements, in the firing position, are again pivoted into the blocking position.

What is disadvantageous with this prior art construction is that the control element which is loaded by the force of a closing spring during the entire movement of the breechblock body exerts a pressure via the control surfaces onto the locking elements, so that the latter are displaced outwardly against the side walls of the breechblock housing. Consequently, there are present frictional losses, which, in order that there can be obtained the strived for firing speed of the weapon, must be compensated by an increased initial velocity of the breechblock. Yet, increased breechblock velocities are associated with increased loading and wear of the material from which the breechblock is formed.

SUMMARY OF THE INVENTION

Hence, it is a primary object of the present invention to provide a new and improved construction of a breechblock for an automatic firing weapon which is not associated with the aforementioned drawbacks and limitations of the prior art proposals as discussed above.

Another and more specific object of the present invention aims at the provision of a new and improved construction of a breechblock by means of which there can be avoided the large friction which prevails between the blocking or locking bodies and the wall of the breechblock housing and the therewith associated drawbacks.

Now in order to implement these and still further objects of the invention, which will become more readily apparent as the description proceeds, the breechblock for an automatic firing weapon as contemplated by the present development, is manifested by the features that a locking bolt is arranged to be displaceable into a recess of the control element, and by means of this locking bolt the breechblock head, which is unlocked from the breeechblock housing, is coupled with the control element. Play is present between the control surface and the breechblock body and by means of which, prior to reaching the firing position of the breechblock head there is uncoupled the control element.

BRIEF DESCRIPTION OF THE DRAWINGS

The invention will be better understood and objects other than those set forth above, will become apparent when consideration is given to the following detailed description thereof. Such description makes reference to the annexed drawings wherein the drawings illustrate three examplary embodiments of the invention and wherein:

FIG. 7 is a vertical longitudinal sectional view of a part of a breechblock body having a device for coupling a breechblock head with the control element, according to a second exemplary embodiment of the invention;

FIG. 8 is a cross-sectional view of the arrangement of FIG. 7, taken substantially along the line VII—VII thereof;

FIG. 15 illustrates a device for coupling both breechblock parts, according to a third exemplary embodiment of the invention, and shown in a position corresponding to the start of the return movement of the breechblock body; and FIG. 16 is a horizontal sectional view through a part of the breechblock body at the start of the return movement of such breechblock body.

DETAILED DESCRIPTION OF THE PREFERRED EMBODIMENTS

Figure 1:
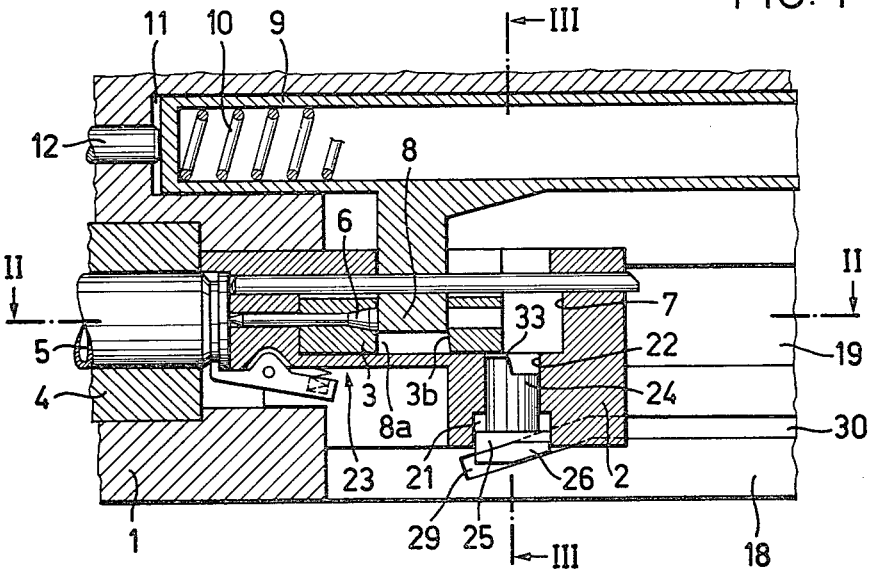
FIG. 1 is a longitudinal sectional view through a part of the firing weapon illustrating a breechblock body located in the firing position and locking position, respectively, and with a device for coupling a breechblock head with a control element, according to a first exemplary embodiment of the invention.

Describing now the drawings, it is to be understood that only enough of the structure of the automatic firing weapon with which the inventive constructions of breechblocks are employed, has been shown in the drawings to enable those skilled in the art to readily understand the underlying principles and concepts of the invention, while simplifying the illustration and preserving clarity thereof. Hence, according to the exemplary embodiment of breechblock for an automatic firing weapon as disclosed in FIGS. 1 and 2 a breechblock body 23 is dispositioned in a breechblock housing 1. This breechblock body 23 has a breechblock head 2 and a control element or member 3. The breechblock body 23 is displaceably mounted in the breechblock housing 1. In the forwardmost position, the so-called firing position, the breechblock head 2 bears at a cartridge 5 located in the weapon barrel 4. Secured in the control element 3 is a firing pin 6 which fires the cartridge 5 in the aforementioned firing position. As best seen by referring to FIG. 3, the control element 3 is inserted into a recess 7 of the breechblock head 2 and is displaceable therein. A spring sleeve 9 possesses a cam or protuberance 8 of substantially rectangular cross-sectional configuration, which engages into a complementary or otherwise suitably configured recess 8*a* in the control element 3. As shown in FIG. 1, a closure spring 10 arranged within the spring sleeve 9 bears at one end against the front end of the spring sleeve 9 and at the other end, in a not particularly illustrated manner, at the breechblock housing 1. The spring sleeve 9 is displaceably mounted in a bore 11 of the breechblock housing 1. An unlocking rod 12, mounted in the breechblock housing 1, protrudes into the bore 11.

Figure 2:
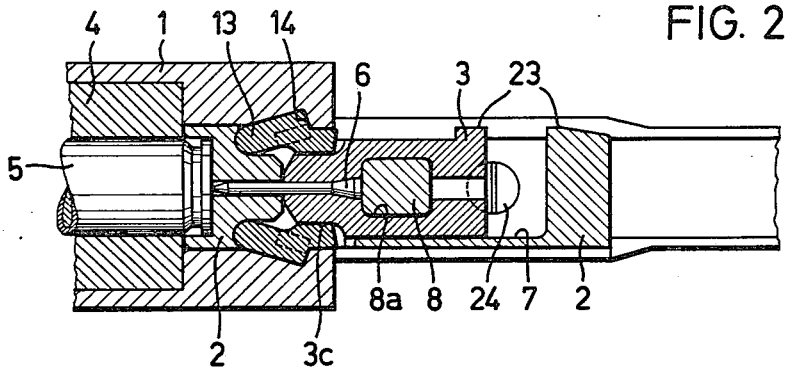
FIG. 2 is a cross-sectional view of the arrangement of FIG. 1, taken substantially along the line II—II thereof.
Figure 6:
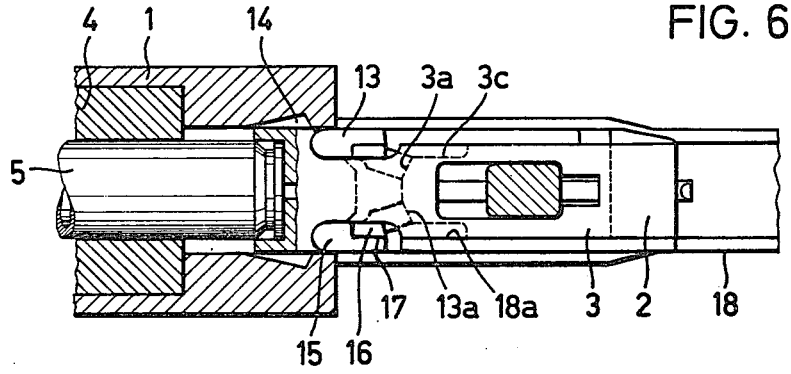
FIG. 6 is a cross-sectional view of the showing of FIG. 5, taken substantially along the line VI—VI thereof.
Figure 3:
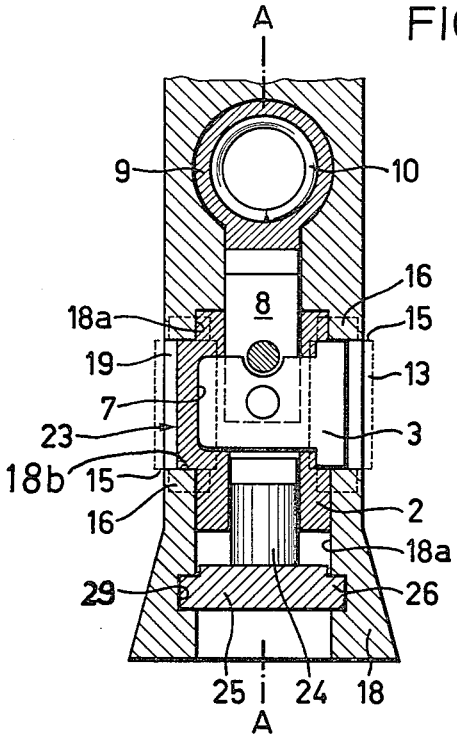
FIG. 3 is a cross-sectional view of the arrangement of FIG. 1, taken substantially along the line III—III thereof.

Turning attention to FIGS. 2, 3 and 6 at this point, it will be seen that two locking elements 13 are conveniently pivotably mounted in any suitable fashion, for instance at pivot pins in the breechblock head 2, and in order to support the same there are provided at the breechblock housing 1 the catch or latch surfaces 14. In FIG. 3 the locking elements 13 have been shown in a simplified manner in phantom lines in a position corresponding to that of FIG. 2. The locking elements 13 are bounded by two mutually parallel surfaces 15 directed perpendicular to the longitudinal central plane A—A (FIG. 3) of the weapon. A respective cam or protuberance 16 is mounted at each such surface 15. As best seen by referring to FIG. 6 the cams 16 possess lateral surfaces 17 which, in the retracted or folded-in position of the locking elements 13, during the movement of the breechblock 23, bear against surfaces 18*a* of the side walls 18 of the breechblock housing 1. These side walls 18 of the breechblock housing 1 possess openings 19 in order to introduce the cartridges 5. In the retracted or folded-in position of such locking elements 13 the latter protrude into the openings 19. The cam 16 of the locking elements 13 prevent the cartridges from dropping out through the openings 19. The breechblock body 23 bears upon the surfaces 18*b* of the breechblock housing 1 which delimit or bound the openings 19, as best seen by referring to FIG. 3.

The control element 3 possesses surfaces 3*a* (FIG. 6) and 3*c* (FIG. 2) which coact with the locking elements 13. The surfaces 3*a*, when the locking elements 13 are in their retracted or folded-in position, are dispositioned opposite the impact surfaces 13*a* of the locking elements 13.

Figure 4:
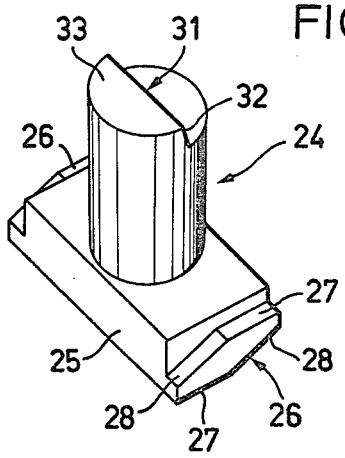
FIG. 4 is a perspective view of a locking bolt employed with the first exemplary embodiment.

Continuing, as best seen by referring to FIG. 1 there is machined or otherwise appropriately formed at the breechblock head 2 a groove or channel 21 extending transversely with respect to the lengthwise axis of the firing weapon. Opening into the groove or channel 21 is a bore 22, the lengthwise axis of which is oriented perpendicular to the groove 21 and to the weapon axis, i.e. barrel 4. At the side opposite the groove or channel 21 the bore 22 opens into the recess 7 provided in the breechblock head 2, and in which the control element 3 is displaceable essentially parallel to the weapon axis. A locking bolt 24 is arranged in the bore 22 as shown in FIG. 4. This locking bolt 24 or equivalent structure possesses a base or bottom portion 25, at each of the two end faces of which there is arranged a guide ledge 26 having two pairs of parallel guide surfaces 27 and 28. Each two neighboring guide surfaces 27, 28 at an end face of the base 25 enclose an obtuse angle with one another. In the side walls 18 of the breechblock housing 1 there are provided guide grooves or channels 30, extending essentially parallel to the lengthwise axis of the weapon and also guide grooves or channels 29 which are inclined with regard to the guide grooves 30, as best seen by referring to FIG. 1. The guide ledges 26 engage with the related guide grooves 29, 30. Furthermore, the locking bolt 24 is provided at the side opposite the base 25 with a semicylindrical projection or protuberance 31 having an end surface or face 33 which is bounded by a surface 32 slightly inclined with respect to the lengthwise axis of the bolt 24 and arranged transversely with respect to the displacement direction of the control element 3. The recess 8*a* in the control element 3 possesses an appropriate surface 3*b* which can be brought into contact with the surface 32, as best seen by referring to FIG. 5.

Now with the second exemplary embodiment, illustrated by way of example in FIGS. 7 and 8, wherein generally the same reference characters have been employed for the same or analogous components, the bore 22 is equipped with a portion 22*a* of enlarged diameter and confronting the groove 21. The locking bolt 24 has a substantially cylindrical locking portion or part 24*a* and a guide body 35. This guide body 35 is displaceably mounted in the widened portion or part 22*a* of the bore 22 and carries the base or bottom portion 25 which possesses a respective guide ledge 26 having two pairs of parallel guide surfaces 27, 28 (FIG. 9), similar to the first described exemplary embodiment of breechblock.

The guide body 35 is provided with a continuous or open-ended bore 36, having a lower widened portion or part 36*a* possessing a shoulder 37. In this part 36*a* there is located a flange 38 of the cylindrical locking part or portion 24*a* which is displaceably inserted into the bore 36 of the guide body 35 and into the bore 22 in the breechblock head 2. The locking part 24*a* possesses a downwardly open blindhole bore 39 and an elongate or extended bore 40 which is directed transverse to its axis. Inserted into the blindhole bore 40 is a pin 41 attached at the base 25 of the guide body 35. Located within the blindhole bore 39 is a spring 42 which bears at one end at the not particularly referenced base of the blindhole bore 39 and at the other end at a bolt 43 or equivalent structure attached to the pin 41. The locking part 24*a* is provided at the side thereof which confronts the recess 7 with the substantially semicylindrical projection or protuberance 31 which is delimited by the end surface 33 and the surface 32 which is slightly inclined with regard to the lengthwise axis of the bolt. In the position of the locking bolt 24 illustrated in FIG. 7 the surface 32 of the locking part 24*a* bears against the corresponding surface 3*b* of the control element 3. The lower surface of the control element 3 has been designated by reference character 45.

According to the showing of FIGS. 10, 12, 14 and 16 the locking elements 13 have locking surfaces 13*b* and impact or stop surfaces 13*a*. In each instance there has only been shown in simplified illustration one of the locking elements 13. In the breechblock housing 1 the catch or latching surfaces 14 with the edges 44 are formed at the transition to the side walls 18 of the breechblock housing 1. The locking surfaces 13*b* are limited by an edge 34. The control element 3 again here has surfaces 3*a* and 3*c* which coact with the locking elements 13.

Continuing, in the third exemplary embodiment of FIG. 15, the locking bolt 24 is constructed of one-piece similar to the first exemplary embodiment, i.e. the locking part is directly equipped with the base 25 carrying the guide ledges 26. The guide grooves 29*a*, inclined with regard to the displacement direction of the breechblock body 23, are however constructed in such a manner that a play, generally indicated by reference character "S", is present between the guide surfaces 28 and the guide groove 29*a* in the displacement direction of the breechblock body 23. The guide grooves 29*a* each possess a front wall 46 and a rear wall 47.

Having now had the benefit of the foregoing discussion and description of the various embodiments of breechblock for an automatic firing weapon there will now be considered the mode of operation thereof:

When the breechblock 23 is located in the firing position illustrated in FIGS. 1 and 2, then the control element 3 assumes its front position in the breechblock head 2 where its end surfaces 3*c* engage behind the locking elements 13 which thus bear at the catch or latch surfaces 14 of the breechblock housing 1. Hence, the locking elements 13 are retained by the surfaces 3*c* in a locking position. The locking bolt 24 is in a release position, i.e. in the lowermost position where its end surface or face 33 is located within the bore 22 and the guide ledges 26 are located in the inclined guide grooves 29.

After firing a shot the unlocking rod 12 or equivalent structure is rearwardly moved in conventional manner, and thus not particularly illustrated in the drawing, due to the pressure of the gases which are branched-off or tapped out of the barrel 4 of the weapon. This rearward movement of the unlocking rod 12 causes it to act upon the spring sleeve 9 and via the cam 8 thereof upon the control element 3. Now the control element 3 moves in the breechblock head towards the rear, and the locking elements 13 are no longer engaged by the surfaces 3*c* and thus are rocked or pivoted into a release position. Under the action of the internal forces of the gases located within the weapon barrel 4 and acting upon the now empty cartridge shell, the breeckblock head 2 has imparted to it a driving action, causing it to move rearwardly in the breechblock housing 1. As a result, the breechblock head 2 accelerates the control element 3, and the locking elements 13 together with their impact surfaces 13*a* bear at the surfaces 3*a* of the control element 3 (FIG. 6). Under the action of the inertia forces which are effective at the control element the locking elements 13 are displaced outwardly, so that their cams 16 bear against the walls 18*a* of the breechblock housing 1. Yet, before there can arise any frictional losses of significance, in other words a loss in the displacement or movement energy of the breechblock body 23, the locking device or mechanism functions in the following manner.

Figure 5:
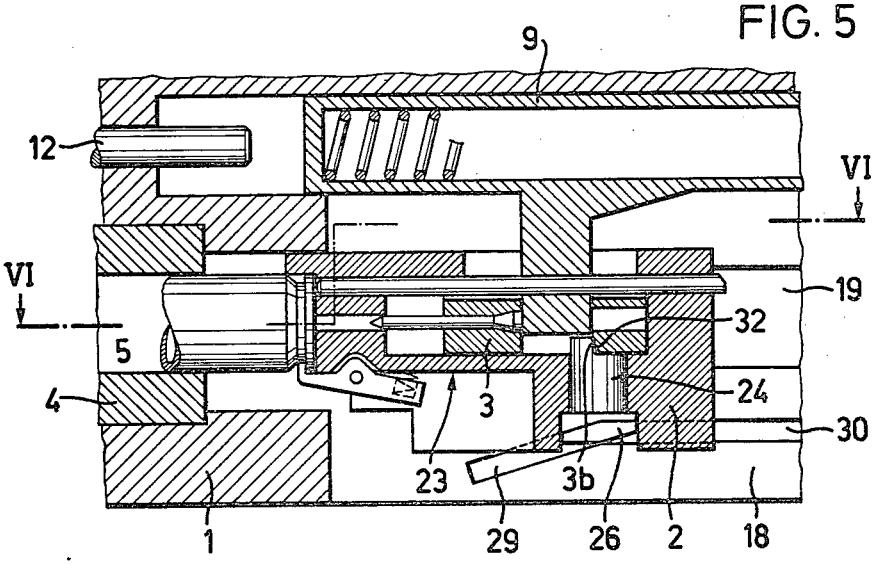
FIG. 5 is a view, corresponding to the showing of FIG. 1, with the breechblock body in the unlocked position.

During the rearward movement of the breechblock head 2 the guide ledges 26 of the locking bolt 24 slide in the inclined guide grooves 29, whereby the locking bolt 24 is moved upwardly into a position as shown in FIG. 5 and its surface 32 is then located in front of the surface 3*b* of the control element 3. Since this surface 32 is slightly inclined, the control element 3 with its surface 3*a* is retracted through a small distance away from the impact or stop surfaces 13*a* of the locking elements 13, so that there does not occur any force transmission from the control element 3 to the locking elements 13. During the further rearward movement of the breechblock body 23 the guide ledges 26 of the locking bolt 24 move in the guide grooves or channels 30 which are parallel to the lengthwise axis of the weapon, so that the control element 3 remains locked with the breechblock head 2. When the breechblock body 23 again travels forwardly, after its rear reversal movement, and the guide ledges 26 again enter into the inclined grooves 29, then the locking bolt 24 is again moved downward.

At the moment when the locking action between the control element 3 and the breechblock head 2 is eliminated, i.e., when the edge between the end surface or face 33 and the surface 32 of the locking bolt 24 departs from the surface 3*b* of the control element 3, the breechblock head 2 is located shortly before its forwardmost position. Until it reaches such the locking bolt 24 moves in the bore 22 and the grooves 29, so that in the firing position there is finally present a play between its end surface 33 and the control element 3 as apparent from the showing of FIG. 1. During the time when the locking bolt 24, following release of the control element 3, has reached its end or terminal position corresponding to the firing position, the control element 3, driven by the closure spring 10, moves forwardly, and thereby rocks the locking elements 13 into the blocking position shown in FIG. 2, and the firing pin 6 fires the cartridge 5 introduced into the cartridge chamber of the weapon barrel 4 during forward movement of the breechblock body 23. Due to the locking of the control element 3 with the breechblock head 2 by means of the locking bolt 24 there is thus prevented that the control element 3, during the movement of the breechblock body 23 under the action of inertia forces and the force of the closure spring 10, will be driven against the locking elements 13 and will spread the latter. As already mentioned, there is thus prevented friction between the locking element-cams 16 and the walls 18*a* of the breechblock housing 1.

With the described first exemplary embodiment the uncoupling of the control element 3 from the breechblock head 2 is accomplished during forward movement of the breechblock body 23 in the same relative position of both parts to one another and with respect to the breechblock housing 1, at which also there is carried out the coupling acting during the return movement. So that during the return movement of the control element 3, which is moved via the unlocking rod 12 in the breechblock head 2 can arrive at the proper position for the start of the coupling operation, a certain time span is also required during the forward movement between the point in time at which there is carried out the decoupling operation and attainment of the forwardmost firing position. During this short period of time the already uncoupled or decoupled control element 3 presses against the locking elements 13, thereby striving to rock such into the locking position. In order to also eliminate the danger of frictional losses between the locking elements 13 and the breechblock housing 1 and any possible unrest or instability in the locking system during this short time span, it is advantageous to resort to the use of the second and third exemplary embodiments of the invention heretofore described.

Figure 9:
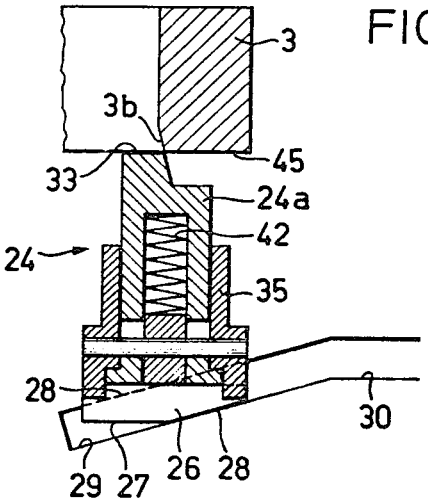
FIG. 9 illustrates a position of the device, corresponding to that shown in FIG. 7, in relation to the control element and a guide track in the breechblock housing during uncoupling of both breechblock parts.
Figure 11:
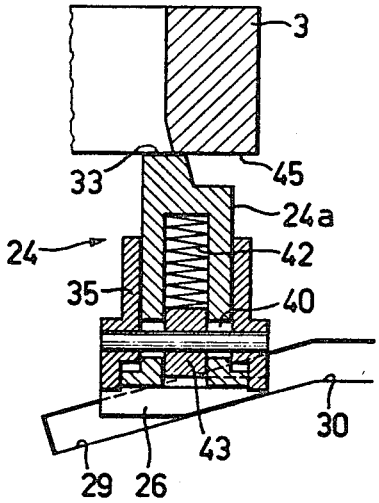
FIG. 11 illustrates a position of the device, corresponding to that shown in FIG. 7, in relation to the control element and the guide track during a first phase of the return movement of the breechblock body.
Figure 10:
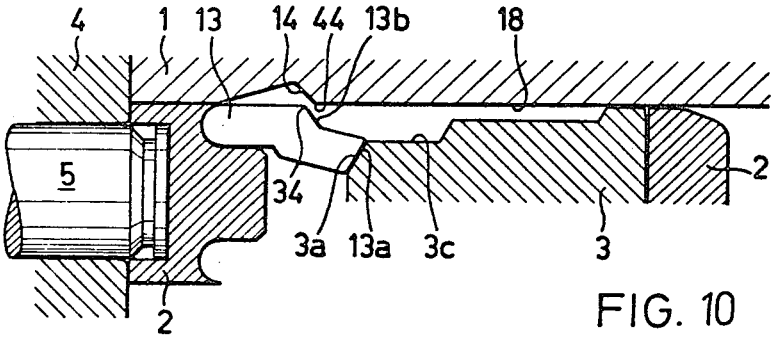
FIG. 10 is a horizontal sectional view through a part of the breechblock body in a position corresponding to the showing of FIG. 9.
Figure 12:
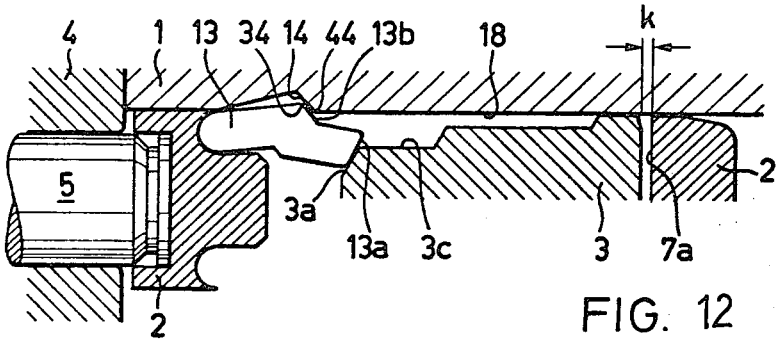
FIG. 12 is a horizontal sectional view through a part of the breechblock body in a position corresponding to the showing of FIG. 11.

Now the mode of operation of the second embodiment is as follows:

During the forward movement of the breechblock body 23 the control element 3 and the breechblock head 2 are operatively coupled with one another by means of the locking bolt 24 and the guide ledges 26 of the locking bolt 24 initially slide in the grooves or channels 30 extending in parallelism with the lengthwise axis of the weapon and thereafter slide in the grooves or channels 29 which are inclined with regard to such weapon axis. The coupling and the locking of both parts is first eliminated by the breechblock head 2 directly prior to reaching the forwardmost firing position (FIGS. 9 and 10). In this position the locking elements 13 no longer bear against the side walls 18 of the breechblock housing 1 and the edges 34 of the locking elements 13 also do not contact the edges 44 at the breechblock housing 1, so that the locking elements 13 are pivoted or rocked into the blocking or locking position without any frictional losses due to the release of the control element 3. The sleeve of the cartridge introduced into the cartridge chamber has already been upset of compressed, so that there no longer exists any danger that there prevails an imbalance or instability in the locking system. After firing the shot the control element 3 is moved in conventional manner rearwardly in the breechblock head 2 by means of the unlocking rod 12 (FIG. 1 and 5). At the moment when the surface 3*c* of the control element 3 no longer engage behind the locking elements 13, as indicated in FIG. 16, there is initiated the inwardly directed pivotal movement of the locking elements 13, and the locking surfaces 13*b* slide along the catch or latch surfaces 14 and the impact surfaces 13*a* are positioned in front of the surfaces 3*a* of the control element 3, as best seen by referring to FIG. 12. During this time the guide ledges 26 of the locking bolt 24 already move again upwardly in the inclined guide grooves 29. The control element 3 however has not yet completed its relative movement in relation to the breechblock head 2 and, for instance, it still spaced by the distance "k" (FIG. 12) from the rearwall 7*a* of the recess 7 in the breechblock head 2. The upwardly moved locking bolt 24 therefore impacts, according to the showing of FIG. 11, by means of its end surface 33 against the lower surface 45 of the control element 3. The locking portion or part 24*a* is stopped, and the guide body 35 which further moves upwardly tensions the spring 42 in that the pin 41 shifts in the elongate hole 40 of the locking part 24*a* and together with the bolt 43 presses against the spring 42.

Figure 13:
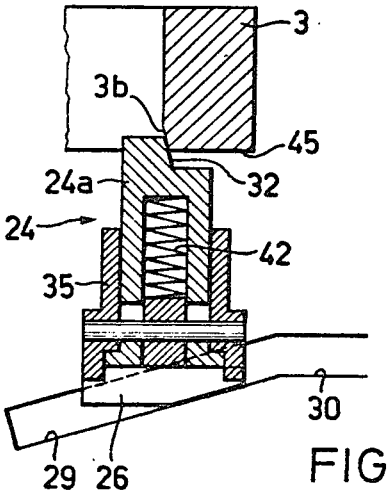
FIG. 13 illustrates a position of the device, corresponding to that of FIG. 7, in relation to the control element and the guide track during a second phase of the return movement of the breechblock body.

After there has been completed the inward pivotal movement of the locking elements 13 and thus the breechblock head 2 is completely uncoupled from the breechblock housing 1 (FIG. 14), then the control element 3 has been pushed back to such an extent in the breechblock head 2 that its lower surface 45 suddenly releases the locking or blocking part 24*a*, which is moved upwardly due to relaxation of the spring 42 until striking against the guide body 35, and its surface 32 is dispositioned in front of the surface 3*b* of the control element 3, as best seen by referring to FIG. 13. The locking of the control element 3 and the breechblock head 2 is initiated. The control element 3, as best seen by referring to FIG. 14, initially still possesses a small play "m" from the rearwall 7*a* of the recess 7 in the breechblock head 2. This play "m" however is eliminated due to the further rearward movement of the breechblock body 23 and thus during the further upward movement of the surface 32 of the locking bolt 24 at the surface 3*b* of the control element 3, so that there is formed the strived for play between the impact surfaces 13*a* of the locking elements 13 and the surfaces 3*a* of the control element 3.

Figure 14:
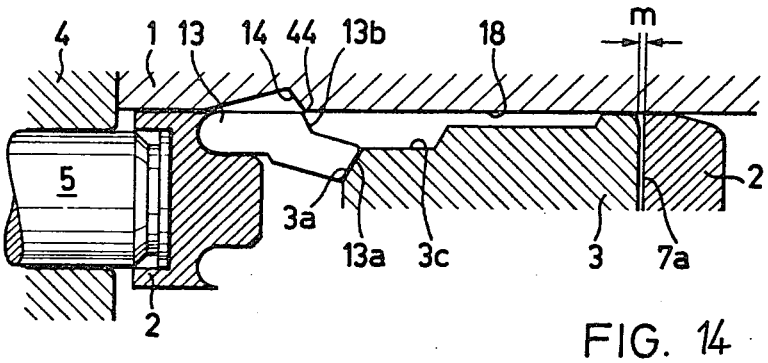
FIG. 14 is a horizontal sectional view through a part of the breechblock body in a position corresponding to FIG. 13.

The mode of operation of the third exemplary embodiment is as follows:

Up to start of the pivotal movement of the locking elements 13 towards the inside, i.e., until unlocking of the breechblock head 2 from the breechblock housing 1, the breechblock head 2 remains in its forwardmost position according to the showing of FIG. 16, and the front guide surface 28 of the guide ledge 26 of the locking bolt 24 bears against the front wall 46 of the guide groove 29*a* (FIG. 15). At the moment when there begins the unlocking of the breechblock head 2 from the breechblock housing 1, the locking bolt 24 still has positioned thereover the control element 3 by the distance "p", as shown in FIG. 15. During the unlocking or decoupling of the breechblock head 2 from the breechblock housing 1 the rear guide surface 28 of the guide ledge 26 approaches the rear wall 47 of the guide groove 29*a*, but however the locking bolt 24 remains in its position as shown in FIG. 15. After the complete unlocking of the breechblock head 2 from the breechblock housing 1, as depicted in FIG. 14, the control element 3 has eliminated the initial positioning of such control element 3 over the locking bolt 24 as previously described. At the same time the guide ledge 26 with the rear guide surface 28 impacts against the rear wall 47 of the guide groove 29*a*, so that during the further rearward movement of the breechblock body 23 the locking bolt 24 is upwardly controlled and the coupling or locking of the control element 3 with the breechblock head 2 is initiated. Also with this exemplary embodiment the slightly inclined surfaces 32 and 3*b* of the locking bolt 24 and the control element 3, respectively, ensure that the control element 3, in the coupled condition, can be easily retracted away from the surfaces 13*a* of the locking elements 13, so that there cannot occur any force transmission from the control element 3 to the locking elements 13 during the common movement of the control element 3 and the breechblock head 2.

With the second and third exemplary embodiments the uncoupling of the breechblock head 2 and the control element 3 occurs during the forward movement and the start of the coupling of both breechblock body parts 2, 3 does not occur during the return movement in the same relative position with respect to the breechblock housing 1. Instead, the breechblock head 2, during the return movement, must move through a longer distance from its forwardmost firing position until there is initiated the coupling operation, since the locking bolt 24, during the return movement, is pushed into the control element 3 with a time delay caused by a play in its axial direction. During the return movement there is available sufficient time for the control element 3 to assume its proper positioning for the start of the coupling operation, yet however there is ensured that during the forward movement the uncoupling operation only then occurs when the breechblock head 2 is located directly in front of its forwardmost firing position. There no longer can occur any friction losses between the locking elements 13 arranged at the breechblock head 2 and the breechblock housing 1 and there also does not exist any danger that instability conditions will arise in the locking system.

While there are shown and described present preferred embodiments of the invention, it is to be distinctly understood that the invention is not limited thereto, but may be otherwise variously embodied and practiced within the scope of the following claims.

Accordingly What we claim is:

1. A breechblock for an automatic firing weapon, comprising:

a breechblock housing;

a breechblock head displaceably mounted in said breechblock housing;

at least one movable blocking body for locking the breechblock head in a firing position with said breechblock housing;

a spring-loaded control element displaceable in the breechblock housing;

said control element having a control surface by means of which there can be positionally shifted the blocking body;

said control element having a recess;

a locking bolt arranged in said breechblock head and displaceable into said recess of the control element;

said locking bolt coupling the breechblock head decoupled from the breechblock housing with the control element;

said control surface and said blocking body coacting with one another so as to provide a certain amount of play therebetween and by means of which the control element is uncoupled prior to reaching the firing position of the breechblock head.

2. The breechblock as defined in claim 1, wherein:

said breechblock housing is provided with guide portions;

guide elements provided for said locking bolt;

said guide elements engaging with said guide portions for controlling the displacement of the locking bolt.

3. The breechblock as defined in claim 1, wherein:

said locking bolt has a lengthwise axis which is arranged substantially perpendicular to the direction of displacement of the control element;

said locking bolt having a surface which is slightly inclined with regard to the lengthwise axis thereof and arranged transversely with respect to the direction of displacement of the control element;

the recess of the control element having a surface with which said slightly inclined surface of the locking bolt can be brought into engagement.

4. The breechblock as defined in claim 2, wherein:

said guide portions of the breechblock housing comprise a guide groove extending essentially parallel to the lengthwise axis of the weapon and a further guide groove inclined with regard to said parallel guide groove.

5. The breechblock as defined in claim 4, wherein:

said guide elements comprise a guide ledge having two pairs of guide surfaces:

two surfaces of said pair of guide surfaces extending substantially parallel to the lengthwise axis of the weapon and the remaining two surfaces extending substantially parallel to said inclined guide groove.

6. The breechblock as defined in claim 5, wherein:

said locking bolt has a base with two oppositely situated ones of said guide ledges;

said breechblock housing being provided with oppositely situated guide grooves;

said two guide ledges engaging with said oppositely situated guide grooves of the breechblock housing.

7. The breechblock as defined in claim 2, wherein:

said locking bolt has a guide body equipped with said guide elements;

said locking bolt further possessing a spring-loaded locking portion displaceable relative to said guide body;

said control element having a lower surface;

said locking portion having an end surface which is supportable at the lower surfaces of the control element.

8. The breechblock as defined in claim 7, wherein:

said breechblock head has a bore in which the guide body is displaceable in a direction perpendicular to the direction of displacement of the control element;

said guide body having a bore in which there is displaceably arranged the locking portion for movement substantially perpendicular to the displacement direction of the control element;

a spring having opposed ends;

one end of said spring bearing at the guide body and the other end of said spring bearing at the locking portion.

9. The breechblock as defined in claim 5, wherein:

play is present in the displacement direction of the control element and the breechblock housing between the inclined guide groove and the guide surfaces extending parallel to said inclined guide groove.

* * * * *